US009011043B2

(12) United States Patent
Stankus et al.

(10) Patent No.: US 9,011,043 B2
(45) Date of Patent: Apr. 21, 2015

(54) ENGINEERED MINE SEAL

(75) Inventors: John C. Stankus, Canonsburg, PA (US); Jinrong Ma, Cheswick, PA (US); Lumin Ma, Cheswick, PA (US)

(73) Assignee: FCI Holdings Delaware, Inc., Wilmington, DE (US)

( * ) Notice: Subject to any disclaimer, the term of this patent is extended or adjusted under 35 U.S.C. 154(b) by 0 days.

(21) Appl. No.: 13/192,839

(22) Filed: Jul. 28, 2011

(65) Prior Publication Data

US 2012/0027521 A1 Feb. 2, 2012

Related U.S. Application Data

(60) Provisional application No. 61/369,317, filed on Jul. 30, 2010.

(51) Int. Cl.

| | |
|---|---|
| ***E02D 29/073*** | (2006.01) |
| ***E02D 25/00*** | (2006.01) |
| ***E21F 17/103*** | (2006.01) |

(52) U.S. Cl.

CPC ..... *E21F 17/103* (2013.01)

(58) Field of Classification Search

CPC ..... E21F 15/02; E21D 11/385; E21D 11/08; E21D 11/102; E21D 11/105; E21D 11/107; E21D 11/40; E21D 15/06; E21D 9/00; E21D 9/14; A62C 3/0221; A62C 2/10; A62C 3/00; E02D 29/045; E02D 29/055

USPC ..... 405/132, 151, 152, 135; 454/169, 168, 454/170, 171, 172; 703/1, 7

See application file for complete search history.

(56) References Cited

U.S. PATENT DOCUMENTS

| | | | |
|---|---|---|---|
| 283,286 | A | 8/1883 | Sawyer |
| 1,478,303 | A | 12/1923 | Snyder |
| 1,594,921 | A | 8/1926 | Barnett |
| 1,766,324 | A | 6/1930 | Berner |
| 2,729,064 | A | 1/1956 | Kennedy et al. |
| 3,747,503 | A | 7/1973 | Lovell |
| 3,927,719 | A | 12/1975 | Maser |
| 3,972,272 | A | 8/1976 | Bagby |
| 4,009,649 | A | 3/1977 | Thimons et al. |
| 4,023,372 | A | 5/1977 | Presler et al. |
| 4,036,024 | A | 7/1977 | Dreker et al. |
| 4,096,702 | A | 6/1978 | Burton |
| 4,102,138 | A | 7/1978 | Dreker et al. |
| 4,201,497 | A | 5/1980 | Artweger |

(Continued)

OTHER PUBLICATIONS

Monaghan, William; Trevits, Michael; Sapko, Michael. Evaluation of Seals using Ground Penetrating Radar. Apr. 2005. http://www.cdc.gov/niosh/mining/pubs/pubreference/outputid1429.htm.*

(Continued)

*Primary Examiner* — Benjamin Fiorello
*Assistant Examiner* — Edwin Toledo-Duran
(74) *Attorney, Agent, or Firm* — The Webb Law Firm

(57) ABSTRACT

A method for designing and fabricating a mine seal includes determining an initial thickness for a mine seal based on a predetermined underground opening, developing and solving a numerical model for response of the mine seal upon application of a blasting pressure, and determining whether the mine seal meets predetermined design criteria. A mine seal having a minimum seal thickness may be fabricated after determining the mine seal meets the predetermined design criteria.

10 Claims, 6 Drawing Sheets

(56) References Cited

U.S. PATENT DOCUMENTS

| | | | | |
|---|---|---|---|---|
| 4,478,535 | A | 10/1984 | Kennedy et al. | |
| 4,516,879 | A | 5/1985 | Berry et al. | |
| 4,547,094 | A | 10/1985 | Kennedy et al. | |
| 4,712,945 | A | 12/1987 | Schrimpf | |
| RE32,675 | E | 5/1988 | Kennedy et al. | |
| 4,770,086 | A | 9/1988 | Gabster | |
| RE32,871 | E | 2/1989 | Kennedy et al. | |
| 4,820,081 | A | 4/1989 | Kennedy et al. | |
| 4,824,289 | A | 4/1989 | Glang et al. | |
| 4,900,607 | A | 2/1990 | Glang et al. | |
| 4,915,540 | A | 4/1990 | Kennedy et al. | |
| 5,044,823 | A | 9/1991 | Burgess | |
| 5,167,474 | A | 12/1992 | Kennedy et al. | |
| RE34,220 | E | 4/1993 | Kennedy et al. | |
| 5,385,504 | A | 1/1995 | Hussey et al. | |
| 5,401,120 | A | 3/1995 | Hussey et al. | |
| 5,469,920 | A | 11/1995 | Conti et al. | |
| 5,683,294 | A | 11/1997 | Maines | |
| 5,725,327 | A | 3/1998 | Hussey et al. | |
| 5,824,912 | A * | 10/1998 | Stankus et al. | 73/786 |
| 5,934,990 | A | 8/1999 | Steffenino et al. | |
| 6,082,828 | A | 7/2000 | Bailey et al. | |
| 6,117,178 | A * | 9/2000 | Whitney et al. | 703/12 |
| 6,164,871 | A | 12/2000 | Kennedy et al. | |
| 6,220,785 | B1 | 4/2001 | Kennedy et al. | |
| 6,357,965 | B2 | 3/2002 | Lammertink et al. | |
| 6,379,084 | B1 | 4/2002 | Kennedy et al. | |
| 6,402,611 | B1 | 6/2002 | Rohrbaugh | |
| 6,419,324 | B1 | 7/2002 | Kennedy et al. | |
| 6,422,790 | B1 | 7/2002 | Damron | |
| 6,450,735 | B1 | 9/2002 | Mills et al. | |
| 6,457,906 | B1 | 10/2002 | Kennedy et al. | |
| 6,575,664 | B1 | 6/2003 | Kassel et al. | |
| 6,592,296 | B2 | 7/2003 | Gutschmidt et al. | |
| 6,662,516 | B2 | 12/2003 | Vandehey et al. | |
| 6,669,551 | B2 | 12/2003 | Kennedy et al. | |
| 6,682,263 | B2 | 1/2004 | Kennedy et al. | |
| 6,688,813 | B2 | 2/2004 | Kennedy et al. | |
| 6,715,961 | B2 | 4/2004 | Kennedy et al. | |
| 6,832,165 | B2 * | 12/2004 | Stankus et al. | 702/43 |
| 6,846,132 | B2 | 1/2005 | Kennedy et al. | |
| 7,010,472 | B1 * | 3/2006 | Vasey-Glandon et al. | 703/6 |
| 7,232,368 | B2 | 6/2007 | Kennedy et al. | |
| 7,267,505 | B2 | 9/2007 | Kennedy et al. | |
| 7,334,644 | B1 | 2/2008 | Ozment | |
| 7,418,373 | B2 * | 8/2008 | Heck, Sr. | 703/10 |
| 2003/0082010 | A1 | 5/2003 | Kennedy et al. | |
| 2004/0175238 | A1 | 9/2004 | Kennedy et al. | |
| 2007/0218825 | A1 | 9/2007 | Howery | |
| 2007/0297861 | A1 | 12/2007 | Sisk | |
| 2009/0240481 | A1 * | 9/2009 | Durrant-Whyte et al. | 703/7 |
| 2010/0042381 | A1 * | 2/2010 | Stankus et al. | 703/1 |

OTHER PUBLICATIONS

Weiss, Eric; Cashdollar, Kenneth; Sapko, Michael. Evaluation of Explosion-Resistant Seals, Stoppings, and Overcast for Ventilation Control in Underground Coal Mining. Dec. 2002. http://www.cdc.gov/niosh/mining/pubs/pdfs/ri9659.pdf.*

Mine Safety and Health Administration. Guidelines for the Seal Design Application. Oct. 20, 2008. http://www.msha.gov/Seals/SealsSingleSource2007.asp.*

Mohamed, Khaled; Yassien, Asmaa; Peng, Syd. Cementitious Plug Seal/Rock Interface Under Static and Dynamic Loadings. Oct. 29, 2009. http://www.cdc.gov/niosh/mining/pubs/pubreference/outputid3483.htm.*

United Facilities Criteria. Structures to Resist the Effects of Accidental Explosions. Dec. 5, 2008. http://www.wbdg.org/ccb/DOD/UFC/ufc_3_340_02.pdf.*

Zipf, Karl; Spako, Michael; Brune, Jurgen. Explosion Pressure Design Criteria for New Seals in U.S. Coal Mines. Jul. 2007. http://www.cdc.gov/niosh/mining/pubs/pdfs/2007-144.pdf.*

Strata Mine Services; "Stratacrete Plug Seal"; 2009.*

Bureau of Mines; "Eastern Coal Mine Geomechanics"; 1986.*

Gadde et al., "A simplified approach to coal mine seal design", ISBN 978-0-615-20009-5, 12th U.S./North American Mine Ventilation Symposium 2008, pp. 233-238.

Kirkwood et al., "Technical Considerations for the Design and Constructions of Mine Seals to Withstand Hydraulic Heads in Underground Mines", SME Preprint No. 95-100, Society for Mining, Metallurgy, and Exploration (SME) Annual Meeting, 1995, pp. 1-9, Denver, Colorado.

* cited by examiner

ENGINEERED MINE SEAL

CROSS REFERENCE TO RELATED APPLICATIONS

This application claims the benefit of U.S. Provisional Application No. 61/369,317, filed Jul. 30, 2010, the entire content of which is hereby incorporated by reference.

BACKGROUND OF THE INVENTION

1. Field of the Invention

The present invention relates to a mine seal and, more particularly, to a plug-type mine seal and a method of designing and forming a plug-type mine seal.

2. Description of Related Art

Mine seals are generally installed in an underground mine entry to separate one portion of the mine from another portion of the mine. For instance, the mine seal may separate the mined area from the active mine area. The separation of areas of the underground mine entry is provided, for among other reasons, to limit the areas that need ventilated and to control toxic or explosive gases. The mine seals are generally constructed of wood, concrete blocks, or cementitious materials that are pumped into forms. Mine Safety and Health Administration (MSHA) regulations presently require that mine seals withstand at least 50 psi overpressure when the atmosphere in the sealed area is monitored and maintained inert and must withstand at least 120 psi overpressure if the atmosphere in the sealed area is not monitored, is not maintained inert, and if various other conditions are not present. See 30 C.F.R. §75.335.

SUMMARY OF THE INVENTION

In one embodiment, a method for designing and fabricating a mine seal includes determining an initial thickness for a mine seal based on a predetermined underground opening, developing and solving a numerical model for response of the mine seal upon application of a blasting pressure, and determining whether the mine seal meets predetermined design criteria.

The method may further include determining constitutive behavior of material used for the mine seal based on laboratory test results. Developing and solving the numerical model may include simulating the response of the mine seal to the blasting pressure, and determining yielding condition and safety factor based on material failure criteria. The method may also include increasing the initial thickness of the mine seal in the numerical model and solving the numerical model until a minimum seal thickness meeting the design criteria is determined. The material failure criteria may be established using Mohr-Coulomb strength criterion and tensile strength criterion. The method may include fabricating a mine seal having a minimum seal thickness that was determined to meet the predetermined design criteria. The initial mine seal thickness may be calculated by the equation $$T_{ini} = \frac{P \times DLF \times W \times H \times SF}{2(W + H) \times \tau_{shear}}$$

where P is a blast pressure (psi), DLF a dynamic load factor, W is a width of the underground opening, H is a height of the underground opening, SF is a safety factor of interface between the mine seal and surrounding rock strata, and $\tau_{shear}$ is a shear strength of the mine seal against the surrounding rock strata. The predetermined design criteria may include: absence of tensile failure at a center of an inby side of the mine seal; minimum average safety factor along a middle line of a larger span interface of 1.5; minimum average interface shear safety factor of 1.5; and minimum seal thickness of about 50% or greater than a short span of the underground opening.

In a further embodiment, a method of forming a mine seal includes installing a first set of mine props and a second set of mine props with the first set of mine props spaced from the second set of mine props to define a space therebetween. The method further includes securing wire mesh and brattice cloth to the first set of mine props and the second set of mine props with the respective first and second sets of mine props, wire mesh, and brattice cloth defining first and second forms. The method also includes supplying a cementitious grout to the space between the first and second forms.

The cementitious grout may be a foamed and pumpable cementitious grout. The first set of mine props may be spaced apart from each other by a distance of about 4 to 5 feet, and the second set of mine props may be spaced apart from each other by a distance of about 4 to 5 feet. The wire mesh may be tied to the respective mine props of the first and second mine props.

In another embodiment, a mine seal includes first and second forms with each form including a plurality of mine props with wire mesh secured to each mine prop and brattice cloth secured to an inner face of the wire mesh. The first and second forms are spaced apart to define a space therebetween. The mine seal also includes cementitious grout positioned in the space between the first and second forms. The cementitious grout may be a foamed and pumpable cementitious grout. The mine props of the first form may be spaced apart from each other by a distance of about 4 to 5 feet, and the mine props of the second form may be spaced apart from each other by a distance of about 4 to 5 feet.

BRIEF. DESCRIPTION OF THE DRAWINGS

DESCRIPTION OF THE PREFERRED EMBODIMENTS

Figure 1:
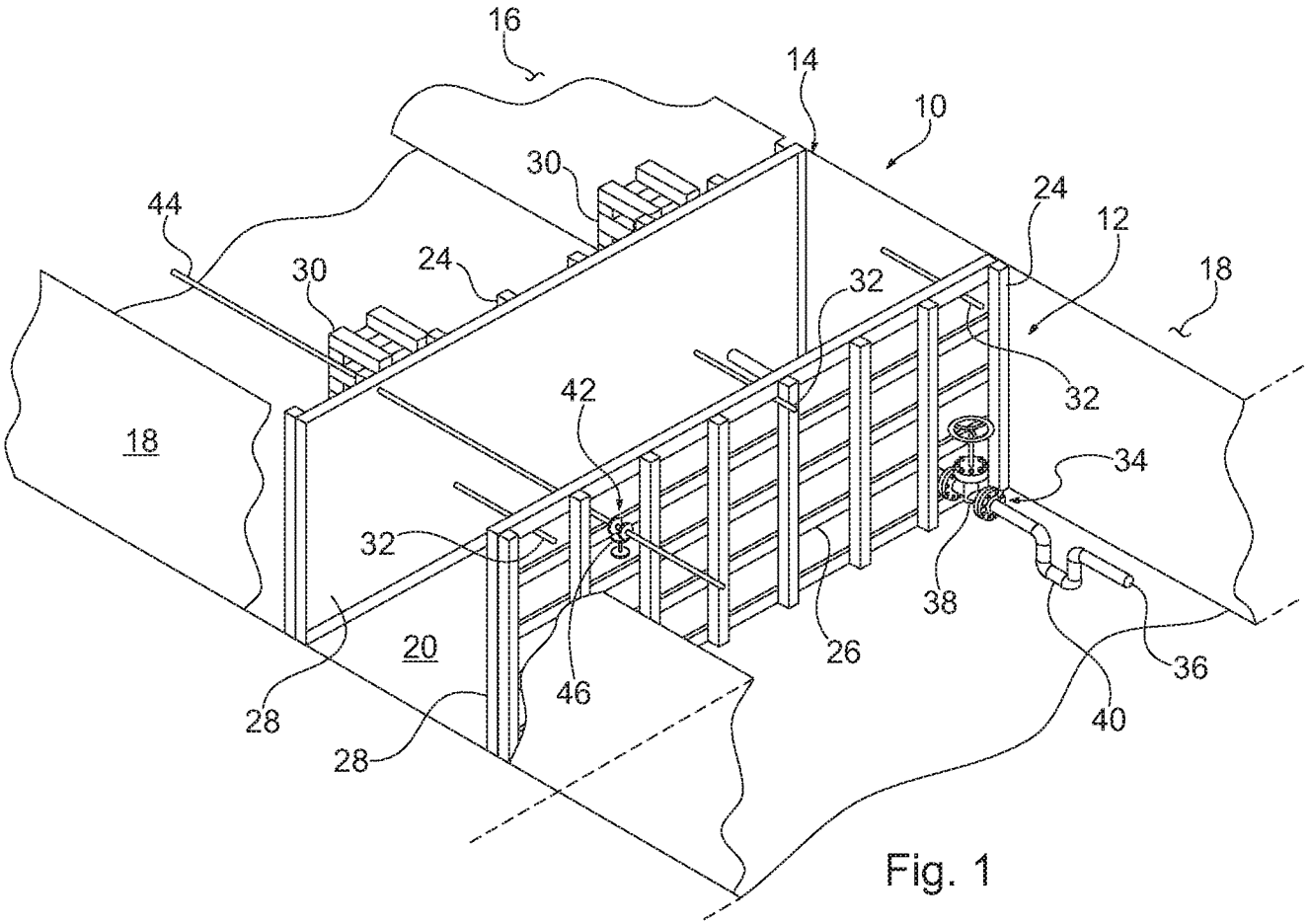
FIG. 1 is a perspective view of a mine seal according to one embodiment of the present invention.

The present invention will now be described with reference to the accompanying figures. For purposes of the description hereinafter, the terms "upper", "lower", "right", "left", "vertical", "horizontal", "top", "bottom", and derivatives thereof shall relate to the invention as it is oriented in the drawing figures. However, it is to be understood that the invention may assume various alternative variations and step sequences, except where expressly specified to the contrary. It is to be understood that the specific apparatus illustrated in the attached figures and described in the following specification is simply an exemplary embodiment of the present invention. Hence, specific dimensions and other physical characteristics related to the embodiments disclosed herein are not to be considered as limiting.

Figure 2:
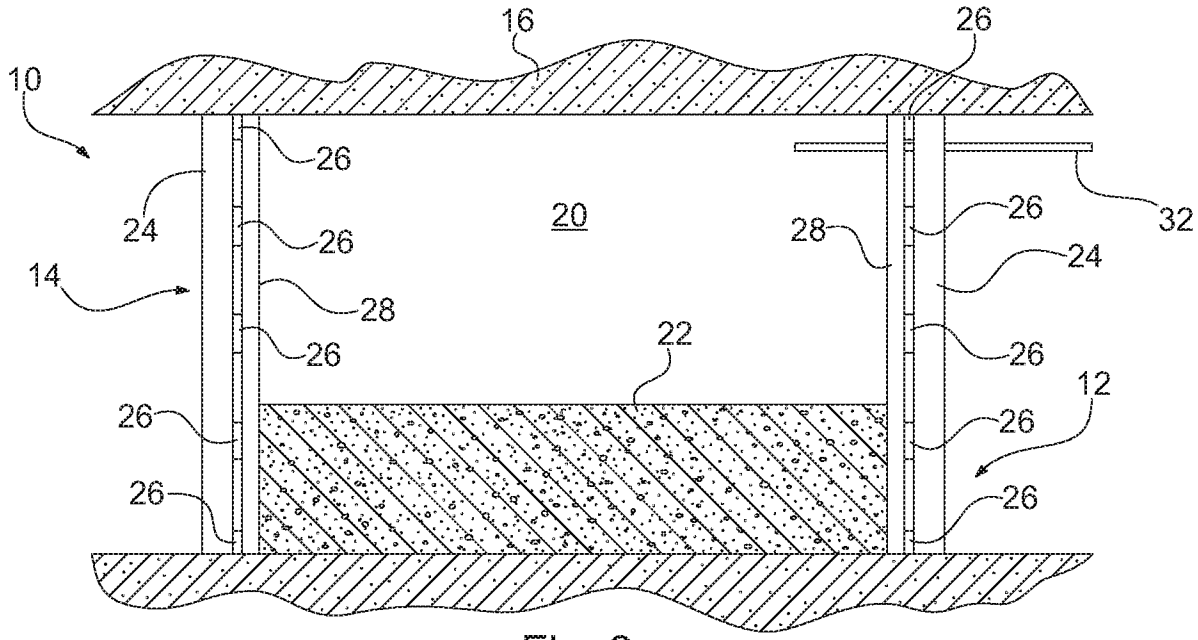
FIG. 2 is a side view of the mine seal of FIG. 1, showing installation of cementitious grout.

Referring to FIGS. 1 and 2, one embodiment of a mine seal 10 for an underground opening is disclosed. The mine seal 10 is formed by a pair of forms 12, 14 positioned adjacent to roof 16 and rib 18 rock strata and spaced apart from each other to define a space 20. The forms 12, 14 are configured to receive a cementitious grout 22 therebetween. Each of the forms 12, 14 includes a plurality of spaced apart posts 24, a plurality of boards 26 attached horizontally to an inner face of the posts, and brattice cloth 28 secured to an inner face of the boards 26. The posts 24 may be 4"×4" wood posts or larger and positioned on centers of 30"±6", although other suitable sizes and types of posts may be utilized. Wood cribs 30 (shown in FIG. 1) may also be utilized to define the forms. The wood cribs 30 may be 6"×6"×30" and installed with a distance of about 36" from crib to crib. The boards 26 may be 1"×6" wood boards attached to the posts 24 on centers of 18"±6". Although not shown, the front/outby form 12 will typically include one or more temporary hatches that allow access to the inside of the forms during the constructions process. Further, a plurality of pressurization fill pipes 32 is positioned through the brattice cloth 28 on the front/outby form 12.

The mine seal 10 also includes a water drainage system 34 for draining water inby of the seal 10. The water drainage system 34 includes a drainage pipe 36 configured to allow gravity drainage of water inby the seal, a valve 38, and a trap 40. The valve 38 and the trap 40 are positioned on the outby side of the drainage pipe 36. The drainage pipe 36 may be non-metallic and corrosion resistant pipe having an internal pressure rating of at least 100 psi for 50 psi seal design and 240 psi for 120 psi seal design. Although only one drainage pipe 36 is disclosed, one or more drainage pipes may be utilized. The mine seal 10 further includes a gas sampling system 42 for testing the air on the inby side of the seal 10. The gas sampling system 42 includes a sampling pipe 44 and a shutoff valve 46 installed outby of the seal 10. The sampling pipe 44 may be non-metallic and corrosion resistant pipe having an internal pressure rating of at least 100 psi for 50 psi seal design and 240 psi for 120 psi seal design. Foam, such as polyurethane foam, may be used around the annular openings formed by the pipes 32, 36, 44 and around the perimeter of the brattice cloth 28 to minimize leakage during the material pressurization.

Referring to FIG. 2, the cementitious grout 22 is shown being positioned between the forms 12, 14. The cementitious grout 22 will be placed such that the grout 22 fills the entire space between the forms 12, 14 and engages the surrounding rock strata of the roof 16 and ribs 18. The cementitious grout 22 may be a foamed, lightweight, pumpable, cementitious grout that gels and begins to cure within a few minutes after placement to define a uniform, homogeneous, and cohesive mass that develops substantial strength (including bonding the surrounding rock strata) within 28 days. The cementitious grout 22 may be installed using a placer machine (not shown) that combines a dry material with water and air and pumps the resulting foamed cementitious grout at a desired location between the forms 12, 14.

Figure 3:
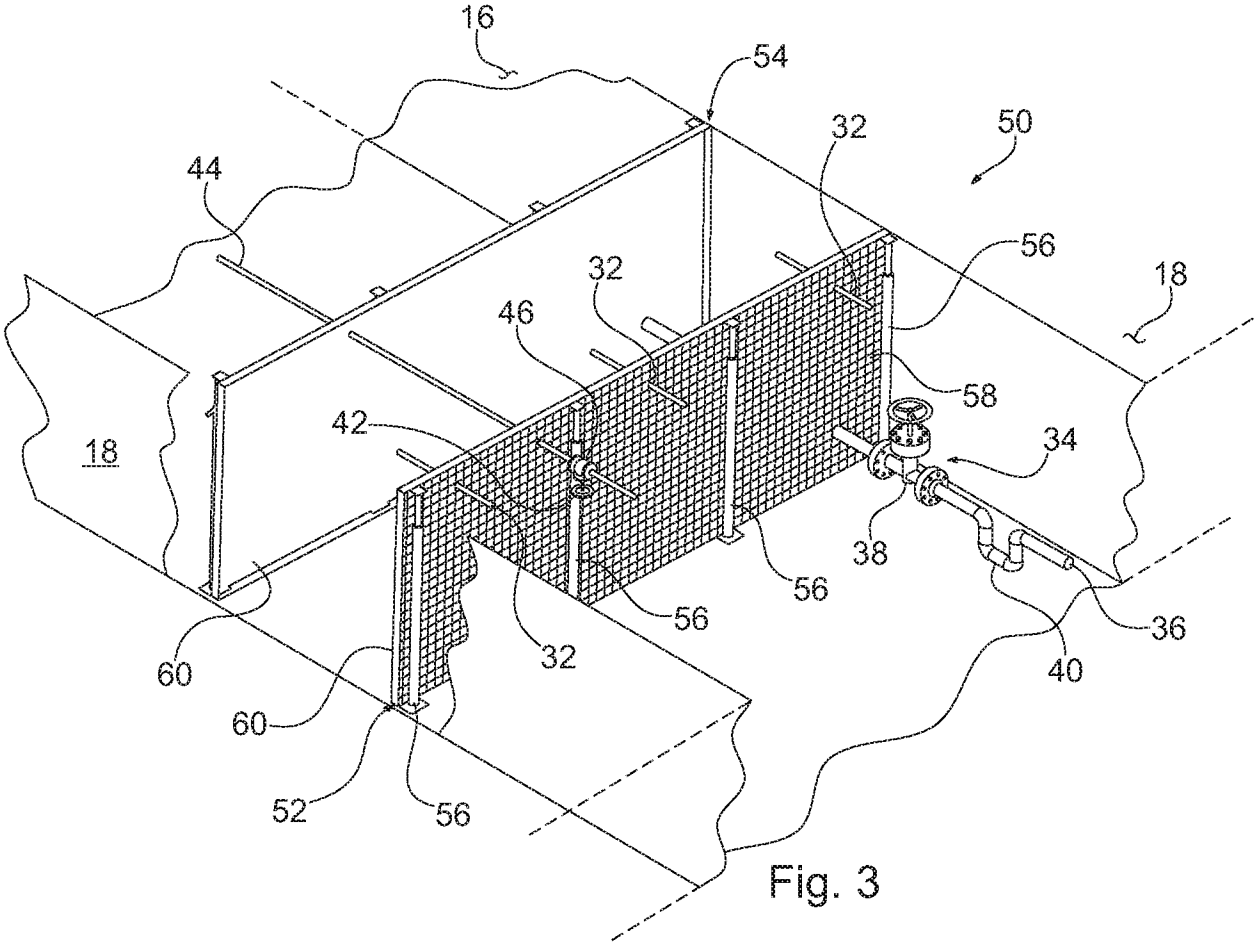
FIG. 3 is a mine seal according to another embodiment of the present invention.

Referring to FIG. 3, a further embodiment of a mine seal 50 for an underground opening is disclosed. The mine seal 50 of the present embodiment is similar to the mine seal 10 shown in FIGS. 1 and 2 and described above. In the mine seal 50 shown in FIG. 3, each of the pair of forms 52, 54 is formed by a plurality of spaced mine props 56, welded wire mesh 58 tied to the mine props 56, and brattice cloth 60 secured to an inner face of the wire mesh 58. The welded wire mesh 58 may be secured to the mine props 56 using wire ties or any other suitable securing arrangement. The mine props 56 may be spaced at about 4'-5'. The mine prop 56 may be a rapid installation prop, such as the RIP 50 mine prop commercially available from Jennmar Corporation, although other suitable props may be utilized. The welded wire mesh 58 may be 12 gauge, 4"×4" grid wire mesh, although other suitable wire mesh may be utilized. The mine seal 50 also includes fill pipes 32, a drainage system 34, and sampling system 42 as discussed above in connection with the mine seal 10 shown in FIGS. 1 and 2. Although not shown, the mine seal 50 also includes the cementitious grout 22 positioned between the forms 52, 54 as described above in connection with the mine seal 10 shown in FIGS. 1 and 2.

Referring again to FIG. 3, the mine seal 50 is formed by installing a first set 62 of the mine props 56 and a second set 64 of the mine props 56. The first and second of sets of mine props 56 are spaced apart to define a space 66 therebetween. The wire mesh 58 and brattice cloth 60 are secured to the first and second sets 62, 64 of mine props 56. In particular, wire mesh 58 and brattice cloth 60 are secured to the first set 62 of mine props 56 and separate wire mesh 58 and brattice cloth 60 are secured to the second set 64 of mine props 56. The brattice cloth 60 faces inwardly towards the space 66. The first and second sets 62, 64 of mine props 56, wire mesh 58 and brattice cloth 60 define the pair of forms 52, 54 as discussed above. Cementitious grout 22 is then supplied to the space 66 between the pair of forms 52, 54 in the same manner as shown in FIG. 2 and described above. The cementitious grout 22 cures and forms a uniform, homogeneous, and cohesive mass.

Figure 4:
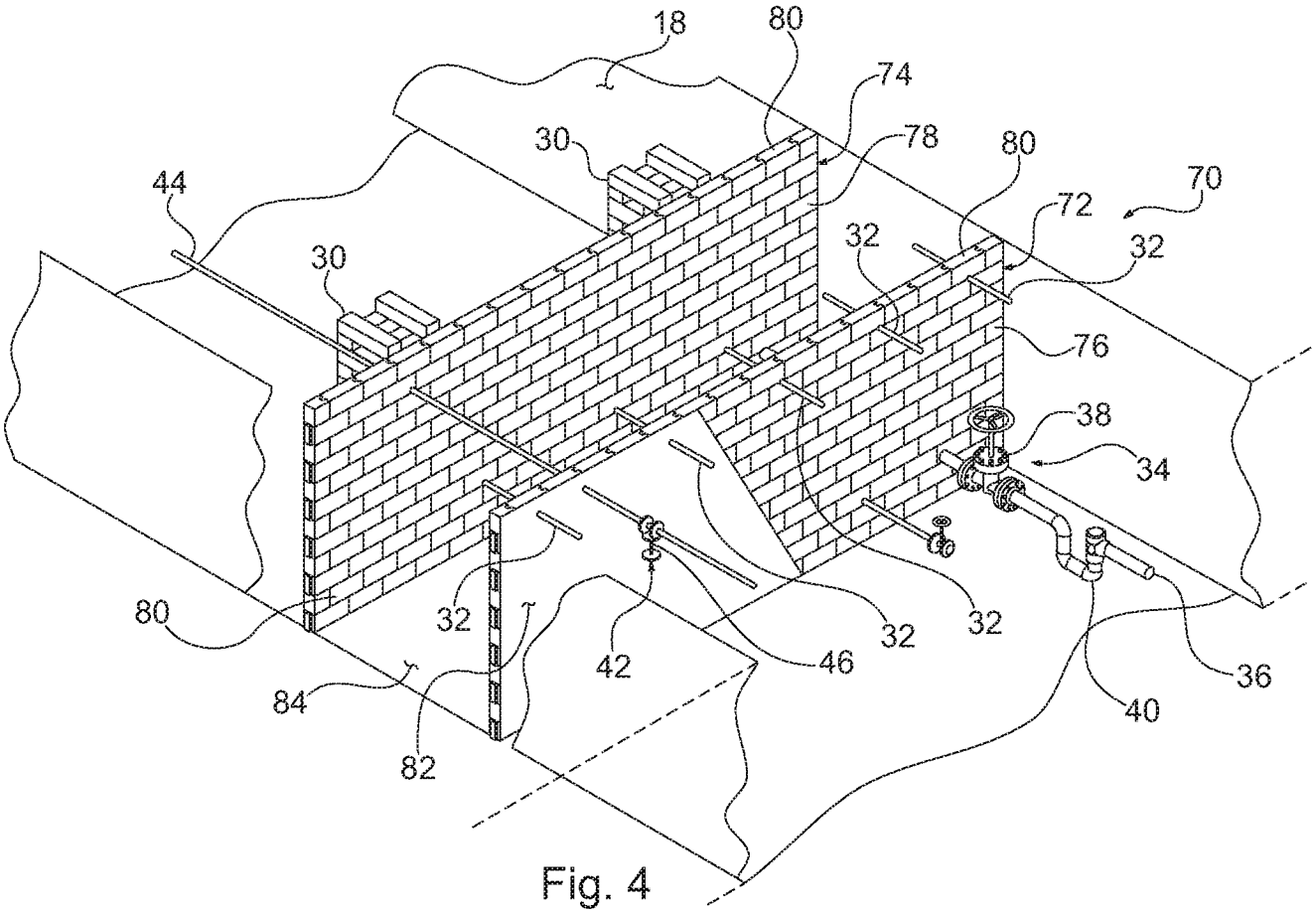
FIG. 4 is a mine seal according to a further embodiment of the present invention.

Referring to FIG. 4, another embodiment of a mine seal 70 for an underground opening is disclosed. The mine seal 70 is similar to the mine seals 10, 50 shown in FIGS. 1-3 and discussed above. The mine seal 70 includes a pair of forms 72, 74 each formed by a respective wall 76, 78. The walls 76, 78 include a plurality of blocks 80 that are joined to each other to form the walls 76, 78. The blocks 80 may be 4"×8"×16" interlocking blocks having a tongue and groove arrangement for securing the blocks to each other. The outer face of each wall 76, 78 also includes a layer of sealant 82 that covers the entire surface of the blocks 80. Wood cribs 30 may also be utilized to define the forms as noted above in connection with the mine seal 10 shown in FIG. 1. The mine seal 70 also includes fill pipes 32, a drainage system 34, and sampling system 42 as discussed above in connection with the mine seal 10 shown in FIGS. 1 and 2. Although not shown, the mine seal 70 also includes the cementitious grout 22 positioned between the forms 72, 74 as described above in connection with the mine seal 10 shown in FIGS. 1 and 2.

Figure 5:
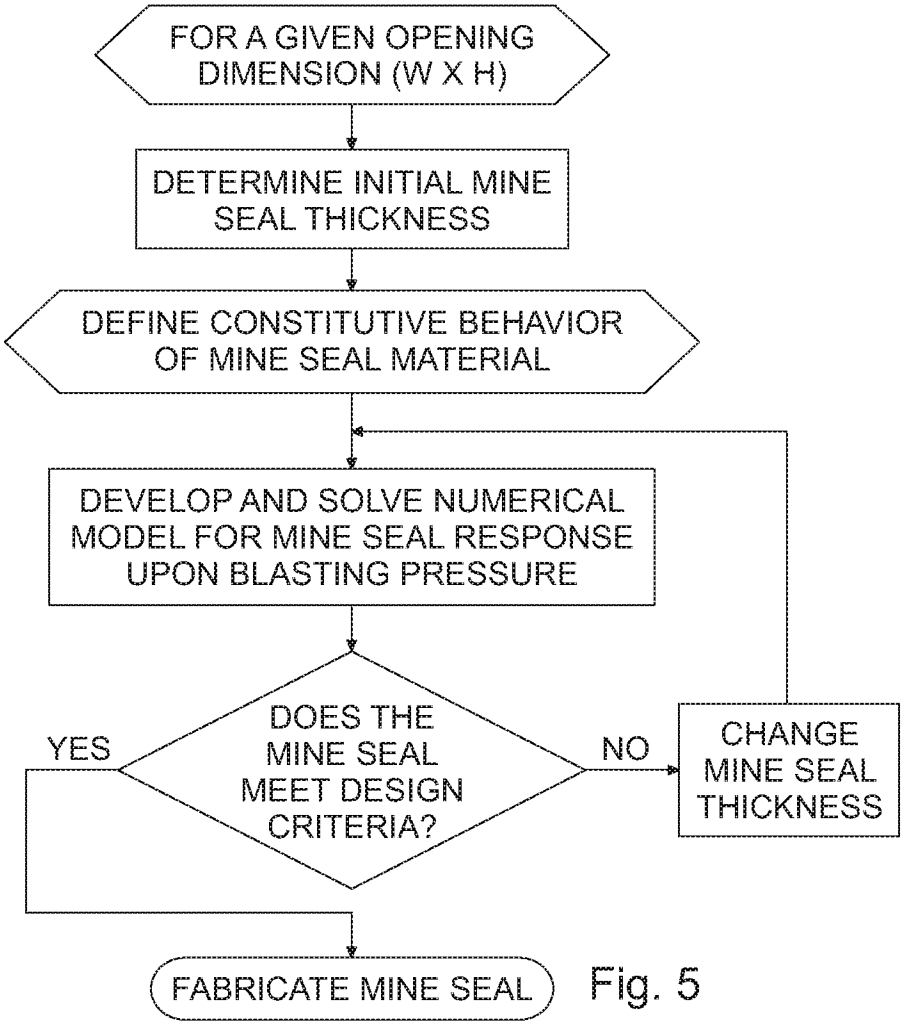
FIG. 5 is a flowchart of a method according to yet another embodiment of the present invention.

Referring to FIG. 5, a method of designing and fabricating a mine seal according to one embodiment is disclosed. The method generally includes the steps of: determining an initial mine seal thickness for a given opening; developing and solving a numerical model for mine seal response upon blasting pressure; and determining whether the mine seal meets predetermined design criteria. A mine seal having a minimum thickness of that determined to meet the design criteria may be fabricated when the mine seal design is determined to meet the design criteria. The mine seal design is based on numerical simulation using specialized software and three-dimensional mine seal models. The models represent the mine seal structures installed in various size mine entries. The models simulate the adequacy of the seal to withstand the blast overpressure applied to the inby face of the seal due to an underground explosion. The minimum thickness of the mine seal is a function of various factors, primarily including explosion overpressure, dynamic load factor, safety factor, entry dimensions, and engineering properties of the seal material. Possible failure modes of a mine seal structure include: (1) if the maximum tensile stresses exceed the material tensile strength, tension failure will occur at the center of the inby side or rock-seal interface perimeter of the outby side; (2) Mohr-Coulomb shear failure propagates through the interface at the longer span of the opening; and (3) Plug-type shear failure. Depending on the mine seal thickness and opening dimensions, a thin seal with a thickness less than half of the opening (short span) may fail in the first mode. A thick seal (thickness greater than half of the shorter span opening) may fail in the second or third modes. Accordingly, the present method of designing and fabricating a mine seal utilizes a combinational methodology that evaluates all three possible failure modes with plug theory and structural numerical analysis as discussed below.

The overpressure imposed on a seal during an explosion event varies and is applied within a very short period of time. Without considering the time-related settlement load from overburden strata, the explosion pressure most likely invokes a dynamic response on the seal. To analyze the dynamic response, the full equation of motion including the inertia and damping effects should be resolved, as described by the following equation:

$$M*a+C*u+K*y=F \quad \text{(Equation 1)}$$

M is the mass of the seal structure;
a is the acceleration vector;
C is the damping matrix;
u is the velocity matrix;
K is the stiffness matrix;
y is the displacement vector; and
F is the force vector.

An approximate numerical modeling technique may be used in the mine seal design. In particular, in order to avoid certain drawbacks of a true dynamic numerical simulation, the Equivalent Dynamic (ED) simulation approach is utilized. By using a Dynamic Load Factor (DLF), a static model may provide similar responses to a fully dynamic model.

With given boundary and loading conditions, actual material engineering properties as inputs, and proper failure criteria, numerical modeling performs analysis by breaking down a real object into a large number of elements, and calculates the stress and strain of each element numerically using a set of mathematical equations. Once each element reaches equilibrium, the software program then assembles stress and strain responses of all the individual elements and predicts the behavior of the whole structure. The numerical modeling allows for realistic response and material yielding with the Mohr-Coulomb failure criteria, the incorporation of actual material engineering properties obtained in the laboratory, and the identification of critical failure areas within the seal and reliable information on seal response and material yielding. Further, the numerical modeling allows for flexibility of conducting parametric mine seal design to accommodate the majority of mine entry dimensions.

In order to meet governmental regulations, mine seal designs must be able to resist explosions of a specific duration and intensity, which are characterized by pressure-time curves. For example, with respect to a 120 psi main line seal, it is believed that possible blast overpressure rises to 120 psi instantaneously after an explosion. Assuming a pressure is present for at least four seconds assures that a seal could be loaded without failure at a DLF of 2. An instantaneous release of the overpressure load is assumed to provide criteria to address the rebound effect that would occur in the seal after the explosive load was removed. The engineering properties of the material used for the mine seal, such as the cementitious grout 22 described above, may be obtained through laboratory testing.

Failure of rock material, concrete, or cementitious material is generally described by Mohr-Coulomb strength criterion, which assumes that a shear failure plane develops in the rock mass if the shear strength $\tau$ generated by normal confinement $\sigma_n$, cohesion c, and angle of internal friction $\phi$ cannot resist the actual maximum shear stress $\tau_{max}$. When failure occurs, the stresses developed on the failure plane are located on the strength envelope. Mohr-Coulomb strength criterion assumes that rock material enters failure state when the following equations are satisfied:

$$\tau = c + \sigma_n \tan\varphi \quad \text{(Equation 2)}$$

$$\sigma_n = \frac{1}{2}(\sigma_1 + \sigma_3) + \frac{1}{2}(\sigma_1 - \sigma_3)\cos(2\theta) \quad \text{(Equation 3)}$$

$$\tau = \frac{1}{2}(\sigma_1 - \sigma_3)\sin(2\theta) \quad \text{(Equation 4)}$$

$\sigma_1$ is the maximum principle stress;
$\sigma_3$ is the minimum principle stress;
c is the cohesion;
$\phi$ is angle of internal friction;
$\theta$ is angle of failure plan, $\theta = \frac{1}{4}\pi + \frac{1}{2}\phi$ With the numerical modeling results, $\sigma_1$ and $\sigma_3$, and rock mechanics data, the failure state of each node can be determined by comparing the value on the left side and right side of Equation 2. If the value of $\tau$ is greater than that of $c+\sigma_n \tan\phi$, the material can be assumed to be in a shear failure mode. Otherwise, it can be considered intact. In the mine seal numerical simulation, a Safety Factor (SF), which is calculated for every element of the mine seal model in each computation step, is defined as:

$$SF = \frac{C + \left[\frac{1}{2}(\sigma_1 + \sigma_3) + \frac{1}{2}(\sigma_1 - \sigma_3)\cos(2\theta)\right]\sigma_n \tan\phi}{\frac{1}{2}(\sigma_1 - \sigma_3)\sin(2\theta)} \quad \text{(Equation 5)}$$

Because the Mohr-Coulomb criteria loses its physical validity when normal stress on the failure plane becomes tensile, a tensile failure criteria was adopted in the mine seal design numerical analysis as shown by the following equation:

$$f_t = \sigma_3 - \sigma_t \quad \text{(Equation 6)}$$

$\sigma_3$ is the minimum principle stress;
$\sigma_t$ is tensile strength of the material For an element within the seal model, the tensile yield is detected when $f_t > 0$. The thickness of the mine seal model is increased until $f_t < 0$. Tensile strength from rock and concrete are usually determined by either the Brazilian or four-point flexural bending test. Thus, the tensile strength of the mine seal material or cementitious grout may be determined through laboratory testing.

The mine seal model utilizes the following predetermined design criteria: (1) no tensile failure at the center of the mine seal inby side; (2) minimum average safety factor along the middle line (lines 1 and 2 shown in FIG. 6A) of the larger span interface is 1.5, where the safety factor is defined per Mohr-Coulomb failure criteria; (3) minimum average interface shear safety factor is 1.5 using plug theory; and (4) minimum seal thickness is no less than 50% of the shorter opening span.

The mine seal model represents the mine seal structure only and does not include the surrounding strata and pre-applied overburden loads. The mine seal model assumes that the gravitational weight of the material for the mine seal will be minimal as the mine seal material is a foamed lightweight cementitious material. As a result, the mine seal can be considered symmetric with respect to the mid-planes of the entry width and height. With this consideration, quarter mine seal models may be used to reduce the number of elements in the model thereby reducing computation time.

Figure 6A:
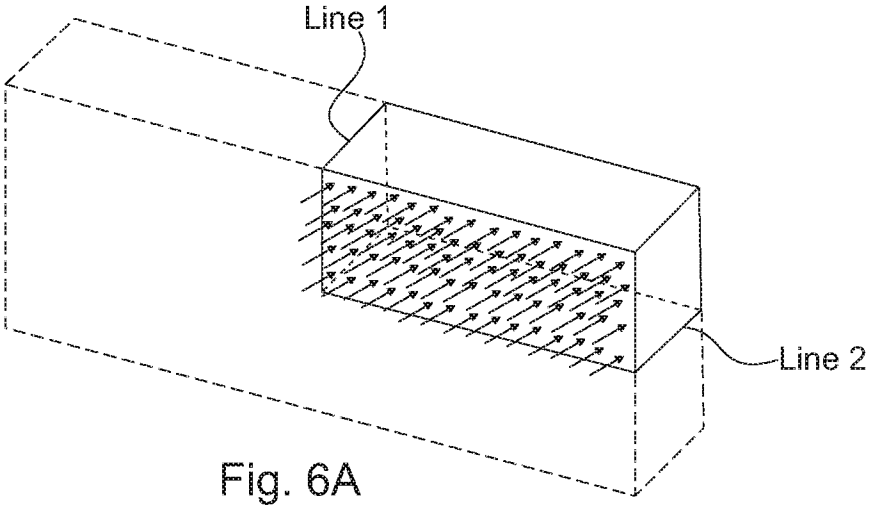
FIG. 6A is a perspective view of a mine seal model according to one embodiment of the present invention.
Figure 6B:
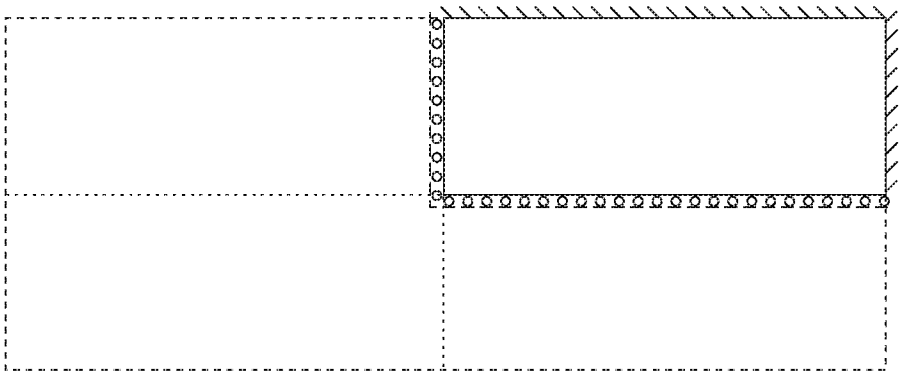
FIG. 6B is a front view of the mine seal model shown in FIG. 6A.

Referring to FIGS. 6A and 6B, schematic drawings of the mine seal model are shown. With proper boundary conditions, the quarter model shown in FIG. 6A provides identical results as the full model. FIG. 6B shows the boundary conditions of the quarter mine seal model. The mine seal model assumes that the mine seal material is bonded to the surrounding strata along the interfaces. Therefore, fixed boundary conditions are applied to the top and side interfaces. To simulate the full model, symmetric boundary conditions are applied to middle planes. The vertical and horizontal middle planes are constrained laterally and vertically at the middle planes, respectively.

To determine the minimum mine seal thickness for a given mine entry size, the model starts with an estimated initial seal thickness based on the plug theory as described by the following equation:

$$T_{ini} = \frac{P \times DLF \times W \times H \times SF}{2(W+H) \times \tau_{shear}} \quad \text{(Equation 7)}$$

P is the blast pressure (psi);

DLF is the dynamic load factor;

W is the entry width (ft);

H is the entry height (ft);

SF is the safety factor of interface between seal and surrounding strata (1.5); and $\tau_{shear}$ is the shear strength of the mine seal against the surrounding rock strata.

With the initial mine seal thickness, the mine seal model calculates the state of stress and strain, yielding, and safety factor as defined by Equation 5 for each element within the mine seal model. Once the model reaches equilibrium, the computer modeling software determines if the estimated seal thickness satisfies the design criteria. If the seal thickness does not meet the design criteria, the model will automatically increase the seal thickness in 0.05' increments and the simulation repeats. This process reiterates until the minimum seal thickness is identified and all of the design criteria are satisfied. The computer modeling software nests four loops, including the innermost loop, to calculate stress-strain and to detect material yielding. The second loop identifies the minimum seal thickness. The third loop is to change entry width with the outermost loop being used to change entry height. The mine seal model is capable of determining minimum seal thickness for a mine entry width and height ranging from 14'-30' and 4'-30', respectively.

A thick-wall, plug-type mine seal, such as the mine seals shown in FIGS. 1-4 and described above, will typically fail along the perimeter in shear mode. Numerical analysis indicates that failure likely initiates from the outermost middle point at the contact interface along the largest span of the mine entry. The mine seal design criteria, as discussed above, ensures minimal material failure at the interface of the larger span and no material yielding at the seal structure inby wall. Under the expected overpressure loading, the majority of material remains intact. For example, for a 20'×12' entry, the mine seal criteria identifies that a minimum of 13.65' of seal material will be required to sustain a 120 psi blast overpressure with a DLF of 2. In this particular example, the average safety factor along the midline of the longer space interface governs the design. With the 13.65' thickness, the mine seal structure will have a safety factor of approximately 1.51 per the plug theory and a tensile safety factor of 1.4 at the center of the inby wall. In the mine seal model, the minimum average safety factor along the middle line (lines 1 and 2 shown in FIG. 6A) may be determined by the following:

$$\mathrm{Min}(SF_{line1}, SF_{line2}) \geq 1.5 \quad \text{(Equation 8)}$$

$SF_{line1}$ is the Safety Factor along line 1 in FIG. 5; and $SF_{line2}$ is the Safety Factor along line 2 in FIG. 5.

The minimum average safety factor along the middle line ensures that only minimal or no material failure is incurred at the interface of the larger span and the majority of material remains intact. A review of stress distribution and yielding patterns indicates that, if the average safety factors along lines 1 and 2 shown in FIG. 6A are greater than 1.5, there will be no tensile failure at the center of the inby wall, the perimeter areas remain in good contact with the roof, floor, and coal ribs, and the seal can resist the applied blast overpressure. Analysis results indicate that the thickness of the seal varies with the dimensions of the opening. A seal in a flat rectangular opening (aspect ratio<0.5) behaves differently than a seal in a rectangular opening (1<aspect ratio<0.5), and a rectangular opening behaves differently than a square opening (aspect ratio=1).

For some small entry openings, the minimum seal thickness as determined by the mine seal model and the design criteria is less than 8'. However, the thickness of the mine seal may be restricted to 8' or larger to enable at least 230 tons of support capacity against the roof strata per foot of seal width, to control roof-floor convergence over time, and to minimize possible air leakage.

After determining an initial thickness of the mine seal, defining the constitutive behavior of the mine seal material through laboratory testing, developing and solving a numerical mine seal model to simulate the response of the mine seal upon blasting pressure, and determining whether the mine seal meets the design criteria, a mine seal having a minimum thickness of that determined to meet the design criteria may be fabricated. The mine seal that is fabricated may be the same as the mine seals 10, 50, 70 shown in FIGS. 1-4 and described above. For instance, the mine seal may be a plug-type seal fabricated by constructing a pair of forms and placing a cementitious grout between the forms.

The methods and systems described herein may be deployed in part or in whole through a machine that executes computer software, program codes, and/or instructions on a processor. For example, the finite element analysis and computer numerical modeling may be performed using commercially available finite element programs such as ANSYS, ABAQUS, NASTRAN, ALGOR, ADINA, and other suitable programs. Other steps of the method, such as determining the initial mine seal thickness and determining whether the mine seal meets the design criteria, may also be deployed through a machine that executes computer software. The processor may be part of a server, client, network infrastructure, mobile computing platform, stationary computing platform, or other computing platform. A processor may be any kind of computational or processing device capable of executing program instructions, codes, binary instructions, and the like. The processor may be or include a signal processor, digital processor, embedded processor, microprocessor, or any variant such as a co-processor (math co-processor, graphic co-processor, communication co-processor, and the like) and the like that may directly or indirectly facilitate execution of program code or program instructions stored thereon. In addition, the processor may enable execution of multiple programs, threads, and codes. The threads may be executed simultaneously to enhance the performance of the processor and to facilitate simultaneous operations of the application. By way of implementation, methods, program codes, program instructions, and the like described herein may be implemented in one or more thread. The thread may spawn other threads that may have assigned priorities associated with them; the processor may execute these threads based on priority or any other order based on instructions provided in the program code. The processor may include memory that stores methods, codes, instructions, and programs as described herein and elsewhere. The processor may access a storage medium through an interface that may store methods, codes, and instructions as described herein and elsewhere. The storage medium associated with the processor for storing methods, programs, codes, program instructions or other types of instructions capable of being executed by the computing or processing device may include, but may not be limited to, one or more of a CD-ROM, DVD, memory, hard disk, flash drive, RAM, ROM, cache, and the like.

The methods and/or processes described above, and steps thereof, may be realized in hardware, software, or any combination of hardware and software suitable for a particular application. The hardware may include a general purpose computer and/or dedicated computing device or specific computing device or particular aspect or component of a specific computing device. The processes may be realized in one or more microprocessors, microcontrollers, embedded microcontrollers, programmable digital signal processors, or other programmable devices, along with internal and/or external memory. The processes may also, or instead, be embodied in an application specific integrated circuit, a programmable gate array, programmable array logic, or any other device or combination of devices that may be configured to process electronic signals. It will further be appreciated that one or more of the processes may be realized as a computer executable code capable of being executed on a machine readable medium.

The computer executable code may be created using a structured programming language such as C, an object oriented programming language such as C++, or any other high-level or low-level programming language (including assembly languages, hardware description languages, and database programming languages and technologies) that may be stored, compiled, or interpreted to run on one of the above devices, as well as heterogeneous combinations of processors, processor architectures, or combinations of different hardware and software, or any other machine capable of executing program instructions.

Thus, in one aspect, each method described above and combinations thereof may be embodied in computer executable code that, when executing on one or more computing devices, performs the steps thereof. In another aspect, the methods may be embodied in systems that perform the steps thereof, and may be distributed across devices in a number of ways, or all of the functionality may be integrated into a dedicated, standalone device or other hardware. In another aspect, the means for performing the steps associated with the processes described above may include any of the hardware and/or software described above. All such permutations and combinations are intended to fall within the scope of the present disclosure.

While several embodiments of the mine seal were described in the foregoing detailed description, those skilled in the art may make modifications and alterations to these embodiments without departing from the scope and spirit of the invention. Accordingly, the foregoing description is intended to be illustrative rather than restrictive.

The invention claimed is:

1. A method for designing and fabricating a mine seal, the method comprising:

determining an initial thickness for a mine seal based on a predetermined underground opening dimension;

developing a numerical model for response of the mine seal upon application of a blasting pressure;

solving the numerical model using a processor;

simulating the response of the mine seal to the blasting pressure using the processor;

determining yielding condition and safety factor of the mine seal based on material failure criteria;

determining whether the mine seal meets predetermined design criteria utilizing the numerical model, wherein the predetermined design criteria comprises:

absence of tensile failure at a center of an inby side of the mine seal;

minimum average Mohr-Coulomb shear safety factor along a middle line of a larger span interface of 1.5;

minimum average interface plug shear safety factor of 1.5; and minimum seal thickness of about 50% or greater than a short span of the underground opening dimension;

increasing the initial thickness of the mine seal in the numerical model and solving the numerical model until a minimum seal thickness meeting the predetermined design criteria is determined.

2. The method of claim 1, further comprising:

determining constitutive behavior of material used for the mine seal based on laboratory test results.

3. The method of claim 1, wherein the material failure criteria is established using Mohr-Coulomb strength criterion and tensile strength criterion.

4. The method of claim 1, further comprising:

fabricating a mine seal having a minimum seal thickness that was determined to meet the predetermined design criteria.

5. The method of claim 1, wherein the initial thickness for the mine seal is calculated by the equation $$T_{ini} = \frac{P \times DLF \times W \times H \times SF}{2(W + H) \times \tau_{shear}}$$

wherein P is a blast pressure (psi), DLF a dynamic load factor, W is a width of the underground opening, H is a height of the underground opening, SF is a safety factor of interface between the mine seal and surrounding rock strata, and $\tau_{shear}$ is a shear strength of the mine seal against the surrounding rock strata.

6. A computer-implemented method for designing and fabricating a mine seal, the method comprising:

determining an initial thickness for a mine seal based on a predetermined underground opening dimension;

developing a numerical model for response of the mine seal upon application of a blasting pressure;

solving the numerical model using a processor; and determining whether the mine seal meets predetermined design criteria utilizing the numerical model, wherein the predetermined design criteria comprises:

absence of tensile failure at a center of an inby side of the mine seal;

minimum average Mohr-Coulomb safety factor along a middle line of a larger span interface of 1.5;

minimum average interface plug shear safety factor of 1.5; and minimum seal thickness of about 50% or greater than a short span of the underground opening, and wherein solving the numerical model using the processor comprises:

calculating stress-strain to detect material yielding;

identifying a minimum seal thickness meeting the predetermined design criteria;

changing an entry height of the predetermined underground opening dimension; and changing an entry width of the predetermined underground opening dimension.

7. The method of claim 6, further comprising:

increasing the initial thickness of the mine seal in the numerical model and solving the numerical model until a minimum seal thickness meeting the predetermined design criteria is determined.

8. The method of claim 6, further comprising:

fabricating a mine seal having a minimum seal thickness that was determined to meet the predetermined design criteria.

9. The method of claim 7, further comprising:

fabricating a mine seal having the minimum seal thickness that was determined to meet the predetermined design criteria.

10. The method of claim 6, wherein the initial thickness for the mine seal is calculated by the equation $$T_{ini} = \frac{P \times DLF \times W \times H \times SF}{2(W + H) \times \tau_{shear}}$$

wherein P is a blast pressure (psi), DLF is a dynamic load factor, W is a width of the underground opening, H is a height of the underground opening, SF is a safety factor of interface between the mine seal and surrounding rock strata, and $\tau_{shear}$ is a shear strength of the mine seal against the surrounding rock strata.

* * * * *